US009613479B2

(12) United States Patent
Starke et al.

(10) Patent No.: US 9,613,479 B2
(45) Date of Patent: Apr. 4, 2017

(54) DEVICE FOR SEPARATING COINS WITH A ROTATING DRIVER DISC

(71) Applicants: WINCOR NIXDORF INTERNATIONAL GMBH, Paderborn (DE); CRANE PAYMENT INNOVATIONS GMBH, Buxtehude (DE)

(72) Inventors: Christian Starke, Paderborn (DE); Thorsten Neumann, Paderborn (DE); Axel Grimm, Steinheim (DE); Stig Goepel, Osten (DE); Wilfried Meyer, Buxtehude (DE)

(73) Assignees: WINCOR NIXDORF INTERNATIONAL GMBH, Paderborn (DE); CRANE PAYMENT INNOVATIONS GMBH, Buxtehude (DE)

( * ) Notice: Subject to any disclaimer, the term of this patent is extended or adjusted under 35 U.S.C. 154(b) by 0 days.

(21) Appl. No.: 14/435,465

(22) PCT Filed: Sep. 18, 2013

(86) PCT No.: PCT/EP2013/069366
§ 371 (c)(1),
(2) Date: Apr. 14, 2015

(87) PCT Pub. No.: WO2014/060172
PCT Pub. Date: Apr. 24, 2014

(65) Prior Publication Data

US 2015/0269803 A1 Sep. 24, 2015

(30) Foreign Application Priority Data

Oct. 15, 2012 (EP) ..... 12188583

(51) Int. Cl.
*G07D 3/00* (2006.01)
*G07D 3/06* (2006.01)
(Continued)

(52) U.S. Cl.
CPC ..... *G07D 3/06* (2013.01); *G07D 3/128* (2013.01); *G07D 3/16* (2013.01); *G07D 9/008* (2013.01)

(58) Field of Classification Search
CPC ..... G07D 3/00; G07D 3/02; G07D 3/06; G07D 3/14; G07D 3/16; G07D 13/00; G07D 9/008
(Continued)

(56) References Cited

U.S. PATENT DOCUMENTS 5,295,899 A * 3/1994 Adams ..... G07D 9/008 453/10
6,772,870 B2 * 8/2004 Sugai ..... G07D 3/06 194/215
(Continued)

FOREIGN PATENT DOCUMENTS

DE 39 11 727 10/1990
DE 39 11 727 A1 * 10/1990 ..... G07D 3/06
(Continued)

OTHER PUBLICATIONS

English Translations of International Preliminary Report on Patentability and Written Opinion—Apr. 30, 2015, PCT/EP2013/069366 (9 pages).
(Continued)

*Primary Examiner* — Mark Beauchaine
(74) *Attorney, Agent, or Firm* — Gerald E. Hespos; Michael J. Porco; Matthew T. Hespos

(57) ABSTRACT

The described device for separating coins comprises a rotatable base disc (32), a delimiting element (34) and a
(Continued)

driver disc (36). A circular ring-shaped sorting track (12) is arranged eccentrically relative to the base disc (32). The driver disc (36) and a circularly arranged conveying element (14) interact in a transfer region (38) such that the lowest layer of coins among a quantity of coins conveyed by the driver disc (36) are pushed underneath the conveying element (14), clamped thereat and conveyed further.

19 Claims, 4 Drawing Sheets

(51) Int. Cl.
*G07D 3/12* (2006.01)
*G07D 3/16* (2006.01)
*G07D 9/00* (2006.01)

(58) Field of Classification Search
USPC ..... 453/7, 11, 12, 14, 49, 57
See application file for complete search history.

(56) References Cited

U.S. PATENT DOCUMENTS 6,945,864 B2 * 9/2005 Hino ..... G07D 3/128 453/14
7,704,133 B2 * 4/2010 Adams ..... G07D 3/14 453/57

FOREIGN PATENT DOCUMENTS

DE 195 43 216 5/1997
WO 93/18488 9/1993

OTHER PUBLICATIONS

International Search Report of Oct. 10, 2013, PCT/EP2013/069366 (9 pages).
European Search Report of Mar. 20, 2013, 12188583.4 (6 pages).

* cited by examiner

DEVICE FOR SEPARATING COINS WITH A ROTATING DRIVER DISC

BACKGROUND

1. Field of the Invention

The invention relates to a device for separating coins, comprising a rotatable base disc and a delimiting element, wherein the base disc and the delimiting element delimit a receiving area, open to the top, for receiving a quantity of coins to be separated, and wherein in the delimiting element an opening for the passage of coins and for the feeding to an elastic conveying element is provided in a transfer region, which conveying element feeds separated coins along a circular ring-shaped sorting track to sorting devices.

2. Description of the Related Art

Devices for handling coins usually have an input compartment into which the coins to be handled can be input in the form of an unsorted quantity of coins. This input quantity of coins is fed to a coin storage container in the form of a receiving area which is defined by means of delimiting elements and from which the coins are further processed. So that the input coins can be checked with respect to their authenticity by means of corresponding sensors and a later sorting can be implemented, it is required that the input coins are separated, i.e. that the coins when fed to a sensor unit and/or a sorting unit do not lie on top of each other and are not arranged laterally next to each other on a transport path.

In order to achieve such a separation, often coin centrifuges are used in which the coins of the quantity of coins received in the coin storage container are arranged on a rotating disc. By means of the centrifugal force acting on the coins upon rotation of the disc, the coins are conveyed outward. In the delimiting element for the coin supply, at least one opening is provided which is formed such that only one coin at a time can pass, as a result whereof the separation of the coins is accomplished.

What is problematic with such known coin centrifuges is that the separation is only accomplished unreliably so that it may easily happen that several coins are simultaneously transported through the opening and thus a minimum distance between the coins required for the further processing is not reliably guaranteed. Further, the opening in the delimiting element can easily be blocked by coins getting wedged therein so that a coin jam occurs which can only be removed by way of a manual intervention.

Further, it is problematic that each time the coin centrifuges have to be adapted to the set of coins to be handled, in that the size of the opening is correspondingly matched to the coin set. The opening or the openings have to be designed such that indeed the largest coin to be handled can be conveyed therethrough but no two of the smallest coins to be handled simultaneously fit through the opening. Likewise, it has to be guaranteed that the thickest coin can pass the opening but not two coins lying on top of each other.

A device for separating coins is known from DE 195 43 216 A1. This device comprises a feeder disc which interacts with a coin removal disc and performs a coin separation in connection with a coin gap. The coins to be separated are fed to a circular sorting track on which the coins are moved in a flat-lying and sliding manner by means of an annularly moved brush device along the sorting track. For sorting the coins to be separated, the sorting track contains openings through which the coins fall.

It is the object of the invention to specify a device for separating coins, by means of which in a large range of coins a reliable separation of the coins from an input quantity of coins is made possible.

SUMMARY OF THE INVENTION

According to the invention a rotatable base disc and delimiting elements interact such that they delimit an open receiving area for receiving a quantity of the coins to be separated. In the delimiting element an opening for the passage of coins and for the feeding to an elastic conveying element is provided in a transfer region. This conveying element conveys separated coins along a circular ring-shaped sorting track to various sorting devices. The sorting track is arranged eccentrically relative to the base disc. Due to this eccentricity, in which the base disc and the circular ring-shaped sorting track are arranged within a construction that is circular in cross-section, a compact small design is achieved for the entire device.

On the base disc a driver disc is arranged concentrically relative to the base disc, wherein the driver disc and the conveying element interact in the transfer region such that coins of the lowest layer of the quantity of coins conveyed by the driver disc are pushed underneath the conveying element and are clamped thereat. The conveying element moves concentrically relative to the circular ring-shaped sorting track so that due to the eccentricity of the base disc, the driver disc and the circular ring-shaped sorting track or the conveying element running along the sorting track a wedge-shaped geometry results, wherein one side of the wedge is formed by the conveying element and the other side of the wedge is formed by the transport direction of the coins conveyed by the driver disc.

By means of the driver disc and the conveying element a distance A is defined which specifies the distance between the lateral surface of the driver disc and the conveying element. In a preferred embodiment, this distance A is smaller than the diameter of the smallest coin to be separated by the device. Here, A can also take a negative value, i.e. an overlapping between driver disc and conveying element may exist. Even more preferred, this distance A is greater than zero and smaller than the diameter of the smallest coin to be separated by the device. Surprisingly, it has been found out that within these ranges a very efficient separation with little errors is accomplished and that a stationary coin separator—described further below can be dispensed with. By the term "greater than zero" it is meant that the driver disc is arranged just so far from the conveying element that the driver disc no longer contacts the conveying element.

The quantity of coins is conveyed by the rotating base disc in the direction of the transfer region, wherein the coins can lie on top of each other in several layers. At its lateral surface, the driver disc only conveys coins of the lowest layer in the direction of the transfer region in which, due to the mentioned wedge-shaped geometry, coin and conveying element approach each other such that the coin conveyed by the driver disc is pushed underneath the conveying element and is clamped thereat. By means of this clamping effect the conveying element then conveys the separated coin further along the circular sorting track. Due to the elasticity of the conveying element both thin and thick coins in a broad thickness range can be clamped and conveyed further. Coins of a higher layer than the lowest layer are not necessarily conveyed in the direction of the transfer region or conveying element by the driver disc but continue to rotate with the rotatable base disc within the delimiting element until they reach the lowest layer on the base disc and are then conveyed by the lateral surface of the driver disc up to the conveying element and clamped thereat. In this way, a reliable separation of the coins given a broad universal applicability for a broad range of coins is accomplished.

The driver disc is in particular rigidly connected to the base disc so that it has the same speed of rotation as the base disc. As a result, a simple structure of the device is achieved. It is, however, likewise conceivable that the driver disc is driven separately and has a higher speed of rotation than the base disc, as a result whereof further technical advantages are achieved, such as a more efficient separation given a relatively slowly rotating base disc.

The driver disc in particular has a height smaller than the smallest thickness of the coins to be processed. In this way, it is guaranteed that only the lowest layer of the quantity of coins is moved in the direction of the conveying element and individual coins are clamped thereat. Thus, a double transport of coins lying on top of each other is prevented.

In a preferred embodiment, the driver disc has at its lateral surface a friction coating, in particular a rubber coating or a sand grain coating. Alternatively, the lateral surface can have a roughened structure or a toothing. By increasing the friction coefficient, coins of the lowest layer are reliably conveyed and there will be no "back-up" of coins in the lowest layer in the transfer region.

An option which is not absolutely necessary but advantageous is to arrange a stationary coin separator in the transfer region. Preferably, the stationary coin separator is used when the distance A between the lateral surface of the driver disc and the conveying element is greater than the diameter of the smallest coin to be separated by the device. If, as described above, the distance A is, however, smaller than the diameter of the smallest coin to be separated by the device, then advantageously a stationary coin separator can be dispensed with. Thus, a preferred embodiment of the present invention relates to a device for separating coins without a stationary coin separator. An even more preferred embodiment of the present invention relates to a device for separating coins without a stationary coin separator, wherein the distance A is smaller than the diameter of the smallest coin to be separated by the device, even more preferred wherein the distance A is greater than zero and smaller than the diameter of the smallest coin to be separated by the device. If a stationary coin separator is used, then it is preferably arranged at the end of the transfer region, as viewed in the direction of rotation of the driver disc. For example, as a coin separator a deflecting element can be provided which feeds coins of the lowest layer reliably to the conveying element. The height of the deflecting element should be slightly lower than the smallest thickness of the coins to be processed. Such a stationary coin separator improves the efficiency of the separation.

The device is in particular designed such that the transport speed of the conveying element is higher than the transport speed of the coins which are transported by the lateral surface of the driver disc. In this way, the elastic conveying element conveys the separated and clamped coins faster away from the transfer region than they are fed by means of the driver disc. As a result, the separation becomes reliable and on the sorting track there result sufficient distances between the separated coins.

In one embodiment, the conveying element comprises a ring-shaped elastic clamping ring and a holding ring made of a rigid material, such as plastic or metal, connected to this clamping ring. For example, the clamping ring is made of rubber or thermoplastic polyurethane (TPU) or of polyurethane (PU). These materials are well suited to apply sufficient clamping force on the separated coins to convey these away from the base disc and to transport them along the sorting track.

Further features and advantages of the invention result from the following description which explains the invention in more detail on the basis of embodiments in connection with the enclosed Figures.

DETAILED DESCRIPTION

Figure 1:
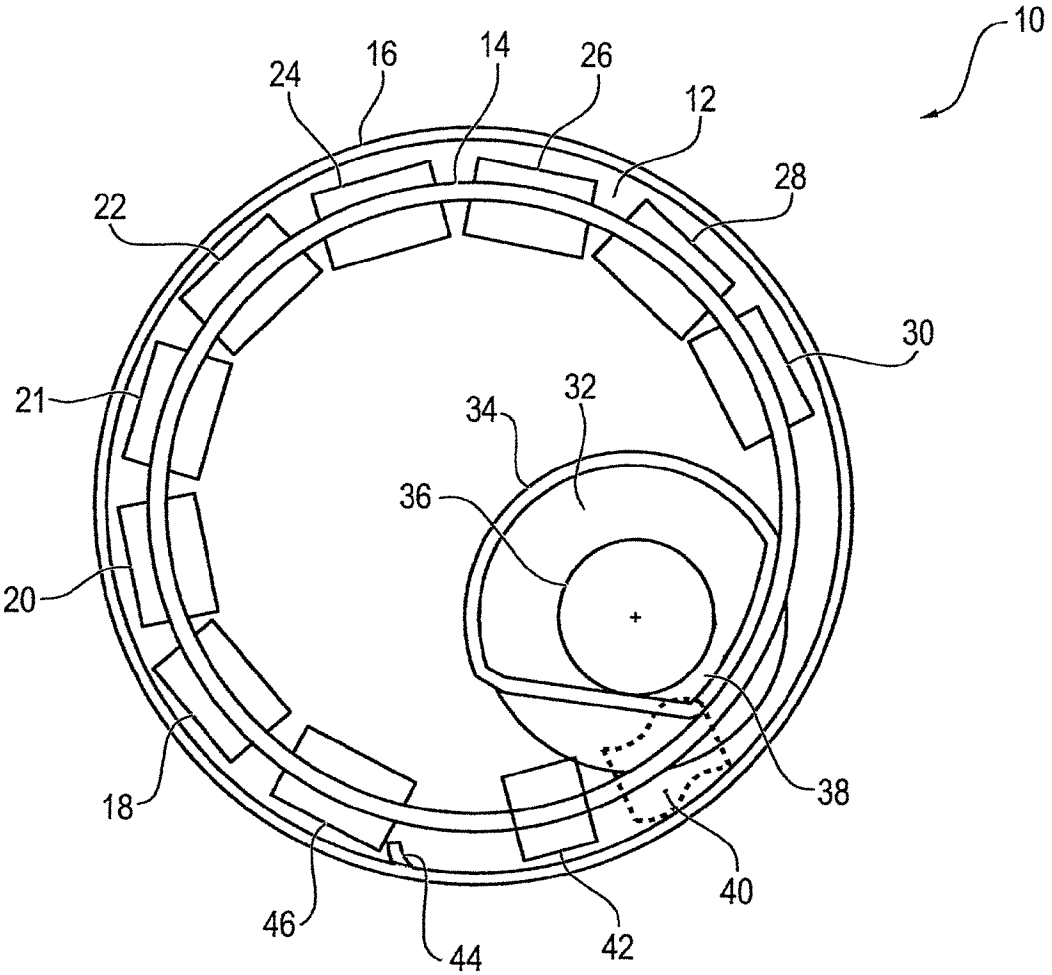
FIG. 1 shows a schematic top view of a device for separating coins, in which the coins are guided on a circular sorting track along its outer track boundary.

FIG. 1 shows a schematic top view of a device 10 for separating coins. These coins have been omitted for reasons of better clarity. The device 10 comprises a circular ring-shaped sorting track 12 which is delimited by an outer sorting track boundary 16. Along the sorting track 12, sorting ejectors 18 to 30 are arranged which contain openings through which the coins fall and which correspond to coins of increasing coin size in the clockwise direction of movement. The coins output by the sorting ejectors 18 to 30 can be counted by means of suitable devices.

Along the sorting track 12 and concentrically relative thereto, an elastic conveying element 14 is arranged which serves to convey separated coins and transports these along the sorting track 12. The elastic conveying element 14 comprises at its underside a ring-shaped elastic clamping ring (not illustrated in FIG. 1) which is mounted on a holding ring made of a rigid material, such as plastic or metal. The separated coins to be conveyed are transported slidingly along the sorting track 12 by means of the clamping ring.

An arrangement for feeding separated coins to the conveying element 14 comprises a rotatable base disc 32, a delimiting element 34 and a driver disc 36, wherein the base disc 32 and the delimiting element 34 delimit a receiving area, open to the top, for receiving a quantity of coins to be separated. In the delimiting element 34, an opening for the passage of coins and for the feeding to the elastic conveying element 14 is provided in a transfer region 38. Typically, the delimiting element 34 can be designed as a funnel which has a larger opening at the top as compared to the lower boundary. The delimiting element 34 can be oval or have any other shape.

On the base disc 32, the driver disc 36 is arranged concentrically relative to the base disc 32. The driver disc 36 is rigidly connected to the base disc 32 and, with respect to the level of the base disc 32, has a height smaller than the smallest thickness of the coins to be processed. The driver disc 36 and the conveying element 14 interact in the transfer region 38 such that, given a clockwise rotation of the driver disc 36 and thus coins conveyed in same direction as the conveying element 14, coins of the lowest layer are pushed underneath the conveying element 14 and are clamped thereat.

The sorting track 12 and thus the conveying element 14 rotating on a circular ring are arranged eccentrically relative to the base disc 32 and thus eccentrically relative to the driver disc 36. Due to this eccentric geometry, a wedge shape results in the transfer region 38, which wedge shape causes that coins of the lowest layer of the quantity of coins conveyed by the lateral surface of the driver disc 36 and given a clockwise rotation are inevitably moved outward in the direction of the conveying element and are thus pushed underneath the conveying element and are clamped thereat. By setting the eccentricity, the wedge shape can be varied and thus be adapted to the size range of the diameter of the coin range.

The coins separated and clamped in this way, are further conveyed clockwise by the elastic conveying element 14 and reach an orientation device 40 which orients the separated coins such that they are conveyed along the outer track boundary 16 by the conveying element 14. On their conveying path, the coins reach a coin checking device 42, known per se, where they are checked for physical properties. Incorrect coins are fed by means of a deflecting device 44, such as a controllable deflector or an extendible pin, to a rejecting ejector 46, where the incorrect coins are sorted out. Correct coins are further conveyed on the sorting track 12 and successively reach the various sorting ejectors 18 to 30, where they are sorted in ascending order dependent on the coin diameter.

Preferably, the driver disc 36 has a friction coating, such as a rubber coating, on its lateral surface. As a result, the transport of the coins of the lowest layer of the quantity of coins by means of the driver disc 36 becomes more efficient and a coin jam is prevented. Due to the rotation of the base disc 32, coins lying over the lowest layer run in a circulating manner within the receiving area into the circle.

The transport speed of the conveying element 12 is higher than the transport speed of the coins which are fed in the transfer region and which are transported by means of the lateral surface of the driver disc 36. In this way, the separated coins are quickly transported out of the transfer region 38 so that along the sorting track 12 the coins are sufficiently spaced apart. Preferably, the speed relations are set such that the speed v1 at which the coins are moved due to the rotation of the base disc 32 is lower than the speed v2 at which the coins of the lowest layer are transported by means of the lateral surface of the driver disc 36 which in turn is lower than the transport speed v3 of the conveying element 14. Accordingly, the following applies to the speeds: $v1<v2<v3$.

Optionally, in the transfer region 38 a stationary coin separator (see FIG. 5) can be formed, in particular in the form of a guide bar, the height of which is slightly smaller than the smallest thickness of the coins to be processed. In this way, it is guaranteed that coins of the lowest layer and no laterally overlapping coins are fed reliably to the conveying element 14, as a result whereof the reliable separation of the coins is further improved.

Figure 2:
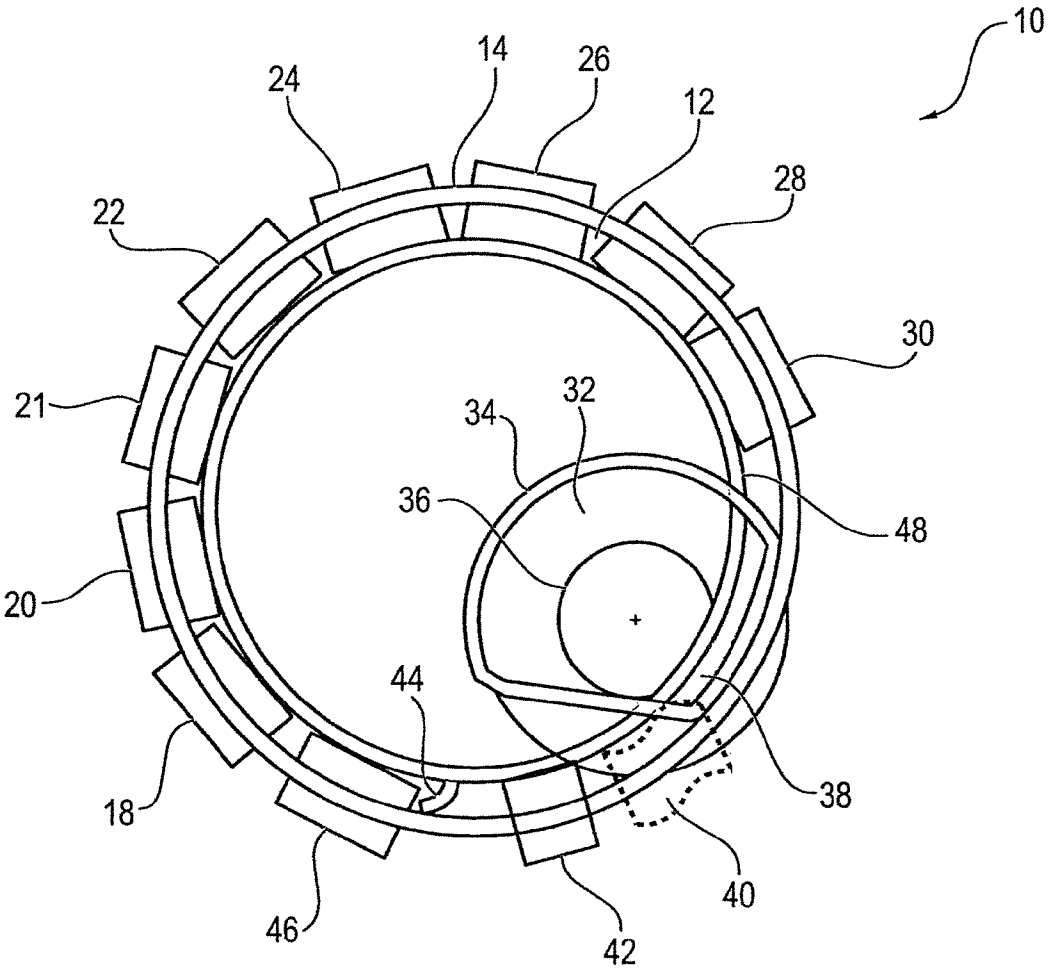
FIG. 2 shows a similar arrangement as FIG. 1, wherein the guidance of the separated coins are conveyed along an inner track boundary of the sorting track.

FIG. 2 shows another embodiment wherein the same parts are identified with the same reference signs. In contrast to FIG. 1, the coins conveyed by the conveying element 14 along the sorting track 12 are oriented by the orientation device 40 such that they are transported along an inner track boundary 48 of the sorting track 12. The function described in connection with FIG. 1 remains the same.

Figure 3:
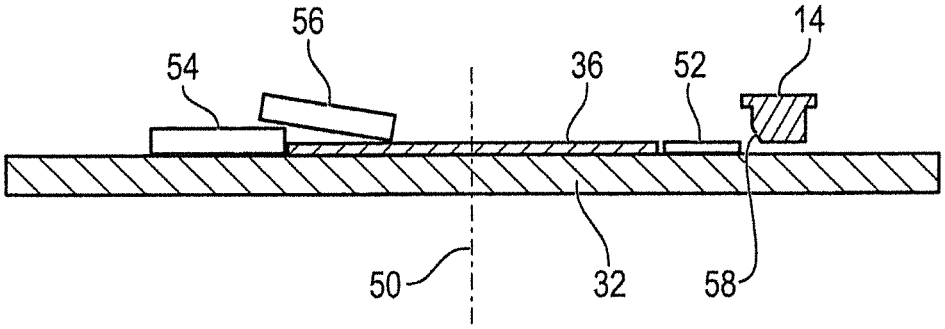
FIG. 3 shows a schematic cross-sectional drawing of the base disc, the driver disc and the conveying element.

FIG. 3 schematically shows a cross-section of the base disc 32, the driver disc 36 and the conveying element 14 in the transfer region 38. The base disc 32 and the driver disc 36 are oriented concentrically relative to an axis 50 and commonly rotate at the same speed of rotation. The driver disc 36 has a height smaller than the smallest thickness of the coin 52 to be processed. Coins of the entire quantity of coins can have different thicknesses and can lie on top of each other as shown in the left-hand image part on the basis of the coins 54 and 56. Only the lowest layer of the quantity of coins is conveyed by the lateral surface of the driver disc 36 in the direction of the conveying element 14. In the illustrated example, the coin 52 still has a distance to the conveying element 14. Due to the wedge shape mentioned further above, upon a further transport, this coin is transported further in the direction of the conveying element 14 by the driver disc 36. This conveying element 14 has a bevel 58 or chamfer facing toward the driver disc 36, as a result whereof a pushing of the coin 52 underneath the conveying element is facilitated. After the coin 52 has been pushed underneath the conveying element 14, which rotates at a higher speed than the base disc 32, due to the clamping effect the coin 52 is quickly conveyed away from the base disc 32 and in the direction of the sorting track 12.

Figure 4:
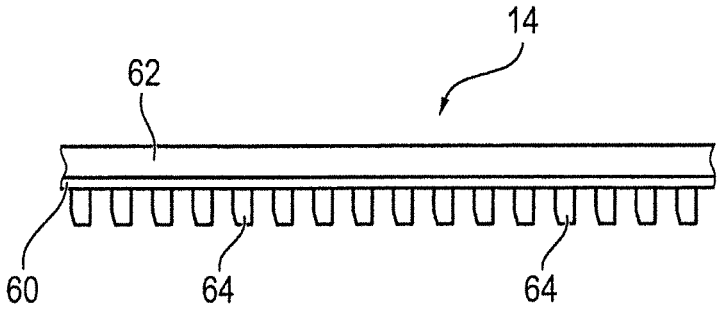
FIG. 4 shows a side view of the conveying element.

FIG. 4 shows a side view of a portion of the conveying element 14. This conveying element 14 comprises an elastic clamping ring 60 and a holding ring 62 made of a rigid material, preferably plastic or metal, and connected to the clamping ring, e.g. by adhesive bonding. The clamping ring 60 is made of thermoplastic polyurethane or of a rubber material and has a plurality of lamellae 64 which can be bent in the longitudinal direction of the conveying element 14, as a result whereof, the clamping force acting on the coins is increased. The lamellae 64 can extend vertically to the longitudinal axis of the holding ring 62 or can be inclined thereto. Moreover, the lamellae 64 can have different angular positions with respect to the transport direction of the conveying element 14. By means of the lamellae 64, it is guaranteed that coins of different thicknesses are reliably conveyed, wherein by means of the elastic deformation of the lamellae 64 an efficient clamping effect is achieved.

Figure 5:
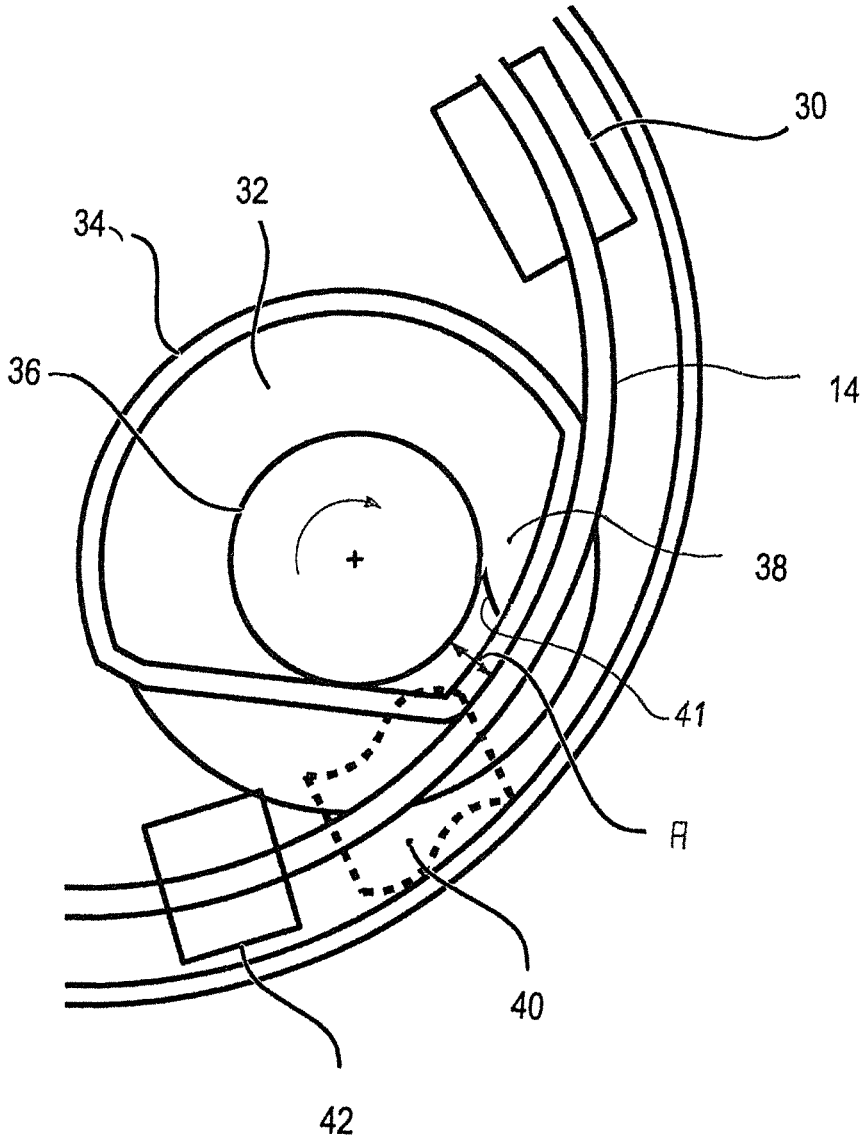
FIG. 5 shows a further embodiment with an additional stationary coin separator.

In a detail, FIG. 5 shows a further embodiment, similar to the one shown in FIG. 1, wherein a stationarily arranged coin separator 41 is provided which, as viewed in the direction of rotation of the driver disc 36, is preferably arranged at the end of the transfer region 38. This coin separator 41 can, for example, be designed as a separate deflecting element which directs coins fed by the lateral surface of the driver disc reliably to the conveying element 14 to be clamped thereat. This is particularly advantageous when the distance A between the lateral surface of the driver disc 36 and the conveying element 14 is greater than the diameter of the smallest coin to be separated by the device.

The described device can be further developed in various ways. The driver disc 36 can be arranged such that it is rotatable independently of the base disc 32. The base disc and the driver disc can also be formed in one piece, the driver disc projecting above the level of the base disc by the described height.

The eccentric arrangement of the base disc 32 and the driver disc 36 with respect to the circular arrangement of the conveying element 14 can be adjustable, as a result whereof the wedge geometry can be varied to be adapted to different sizes of the coins to be processed. By means of the shown device all international coins in the diameter range between 14.5 mm to 33 mm can be separated reliably. The speed of rotation for the base disc can be substantially lower than the one of conventional coin centrifuges which usually use rotation discs. The coins output by the sorting ejectors can directly be supplied to a cash register or a coin storage.

LIST OF REFERENCE SIGNS

10 device for separating coins
12 sorting track
14 conveying element
16 outer sorting track boundary
18 to 30 sorting ejectors
32 base disc
34 delimiting element
36 driver disc
38 transfer region
40 orientation device
41 stationary coin separator
42 coin checking device
44 deflecting device
A shortest distance between lateral surface of the driver disc and conveying element
v1 speed of the coins due to the rotation of the base disc
v2 speed of the coins of the lowest layer due to the rotation of the driver disc
v3 transport speed of the conveying element
46 rejecting ejector
48 inner track boundary
50 axis
52, 54, 56 coins
58 bevel
60 clamping ring
62 holding ring
64 lamellae

The invention claimed is:

1. A device for separating coins, comprising:
a circular sorting track (12);
an elastic conveying element (14) for conveying the coins along the circular sorting track (12);
a base disc (32) arranged eccentrically relative to the circular sorting track (12) and rotatable about an axis inward of the elastic conveying element (14);
a driver disc (36) arranged concentrically on the base disc (32) and rotatable about the axis of the base disc (32);
a delimiting element (34) upward of the base disc (32) and cooperating with the base disc (32) for delimiting a receiving area with an open top for receiving a quantity of coins to be separated;
a transfer region (38) in an area of the delimiting element (34) adjacent the base disc (32) and between the driver disc (36) and the elastic conveying element (14), the transfer region (38) having an opening for passage of the coins and for feeding the coins to the elastic conveying element (14), so that the conveying element (14) feeds separated coins along the circular sorting track (12) to sorting devices (18 to 30),
and wherein the driver disc (36) and the conveying element (14) interact in the transfer region (38) such that the coins of a lowest layer of a quantity of coins conveyed by the driver disc (36) are pushed underneath the conveying element (14) and are clamped thereat.

2. The device of claim 1, wherein the driver disc (36) is rigidly connected to the base disc (32).

3. The device of claim 1, wherein the driver disc (36) has a height that is smaller than the smallest thickness of the coins (52) to be processed.

4. The device of claim 1, wherein a transport speed (v3) of the conveying element (14) is higher than a transport speed (v2) of the coins that are transported by the lateral surface of the driver disc (36).

5. The device of claim 1, wherein a center of the base disc (32) is arranged within the circular track of the sorting track (12) such that the base disc (32) and the conveying element (14) overlap in the transfer region (38).

6. The device of claim 1, wherein along the circular track of the sorting track (12), as viewed in transport direction of the individual coins, a coin checking device (42), a curve ejector (44), a rejecting ejector (46) and a plurality of sorting ejectors (18 to 30) are arranged.

7. The device of claim 1, wherein the conveying element (14) is arranged with respect to a lateral surface of the driver disc (36) such that coins having a diameter range between 14 and 33 mm can be clamped underneath the elastic conveying element (14).

8. The device of claim 1, wherein the transfer region (38) is substantially wedge-shaped so that a distance between an outer circumference of the driver disc (36) and the elastic conveying element gradually decreases in a rotating direction of the base disc (32) to a minimum distance (A) that is shorter than the diameter of the smallest coin to be separated by the device.

9. The device of claim 1, wherein the driver disc (36) has a friction coating, in particular a rubber coating, on its lateral surface.

10. The device of claim 9, wherein the device does not comprise any stationary coin separator (41).

11. The device of claim 9, wherein a distance (A) between the lateral surface of the driver disc (36) and the conveying element (14) is shorter than the diameter of the smallest coin to be separated by the device.

12. The device of claim 9, wherein the conveying element (14) comprises a ring-shaped elastic clamping ring (60) and a holding ring (62) made of a rigid material and connected to the clamping ring.

13. The device of claim 12, wherein the ring-shaped elastic clamping ring (60) is made of polyurethane or of a rubber material.

14. The device of claim 1, wherein the sorting track (12) has an inner track boundary (48) extending concentrically relative to the conveying element (14), and that the separated coins are transportable along the inner track boundary (48) by the conveying element (14).

15. The device of claim 14, wherein the sorting track (12) has an outer track boundary (16) extending concentrically relative to the conveying element (14), and the separated coins (52) are transportable along the outer track boundary (16) by the conveying element (14).

16. The device of claim 14, wherein, as viewed in a transport direction of the separated coins, an orientation device (40) is arranged after the transfer region (38) and orients the separated coins such that they are conveyed along the inner track boundary (48) or along the outer track boundary (16) by the conveying element (14).

17. The device of claim 1, wherein an outer circumference of the driver disc (36) faces an inner circumference the elastic conveying element (14) with a distance therebetween gradually decreasing farther into the transfer region (38) in a rotating direction of the base disc (32).

18. The device of claim 17, wherein a minimum distance (A) between the outer circumferential surface of the driver disc (36) and the circular conveying element (14) is shorter than the diameter of the smallest coin to be separated by the device.

19. The device of claim 17, wherein a corner between an inner circumferential surface of the circular conveying element (14) and a lower surface of the circular conveying element (14) is chamfered to facilitate entry of the coins between the circular conveying element (14) and the sorting track (12).

* * * * *